United States Patent [19]

Keeton

[11] Patent Number: 4,679,515

[45] Date of Patent: Jul. 14, 1987

[54] PROCESS AND APPARATUS FOR STITCHING EXCESS THREAD CHAIN ON A SEWING MACHINE

[76] Inventor: J. Herbert Keeton, 747 Meader St., P.O. Box 296, Campbellsville, Ky. 42718

[21] Appl. No.: 866,561

[22] Filed: May 23, 1986

[51] Int. Cl.[4] ..... D05B 65/06

[52] U.S. Cl. ..... 112/262.1; 112/130; 112/276; 112/288

[58] Field of Search ..... 226/153; 112/318, 288, 112/130, 291–298, 262.1, 271, 276, 277; 271/119

[56] References Cited

U.S. PATENT DOCUMENTS

| | | | |
|---|---|---|---|
| 1,472,964 | 11/1923 | Donnell et al. | 226/153 |
| 2,955,553 | 10/1960 | Winberg | 112/318 |
| 3,699,907 | 10/1972 | Anderson et al. | 112/130 X |
| 4,038,933 | 8/1977 | Marforio . | |
| 4,108,097 | 8/1978 | Gross et al. | 112/288 |
| 4,149,478 | 4/1979 | Sanvito et al. . | |
| 4,152,995 | 5/1979 | Klundt | 112/318 |
| 4,187,793 | 2/1980 | Fietta et al. . | |
| 4,220,105 | 9/1980 | Palacino . | |
| 4,303,030 | 12/1981 | Palacino et al. | 112/288 |
| 4,453,481 | 6/1984 | Garnett et al. | 112/288 |
| 4,470,362 | 9/1984 | Kear | 112/276 |
| 4,523,535 | 6/1985 | Blackburn | 112/288 |
| 4,607,583 | 8/1986 | Biermann et al. | 112/288 X |

FOREIGN PATENT DOCUMENTS 2058858 4/1981 United Kingdom .

*Primary Examiner*—Werner H. Schroeder
*Assistant Examiner*—Andrew M. Falik
*Attorney, Agent, or Firm*—Nixon & Vanderhye

[57] ABSTRACT

An attachment for a semi-automatic sewing machine ensures that any excess thread chain extending from the leading or trailing edge of a garment during an operation on the garment with the sewing machine, is stitched directly to the garment so that no loose or free ends of thread chain are provided. The completion of stitching by the sewing machine of a first garment is sensed with an electric eye, and the first garment is engaged in response to the sensing by a rubber wheel which moves the garment away from the stitching needle more quickly than the sewing machine stitches the stitch chain. The excess thread chain is automatically severed by a movable plate rotating with respect to a stationary plate, and the excess severed thread chain is automatically positioned (by a blower, a catcher and a block of rubber) so that excess thread chain is stitched to the second garment by the sewing machine. Stitching action of the sewing machine is automatically stopped by a drop-off linkage arrangement which includes a linear actuator and rod connected to the foot pedal for the sewing machine, and an arm for actuating the sewing machine clutch.

19 Claims, 7 Drawing Figures

FIG. 2
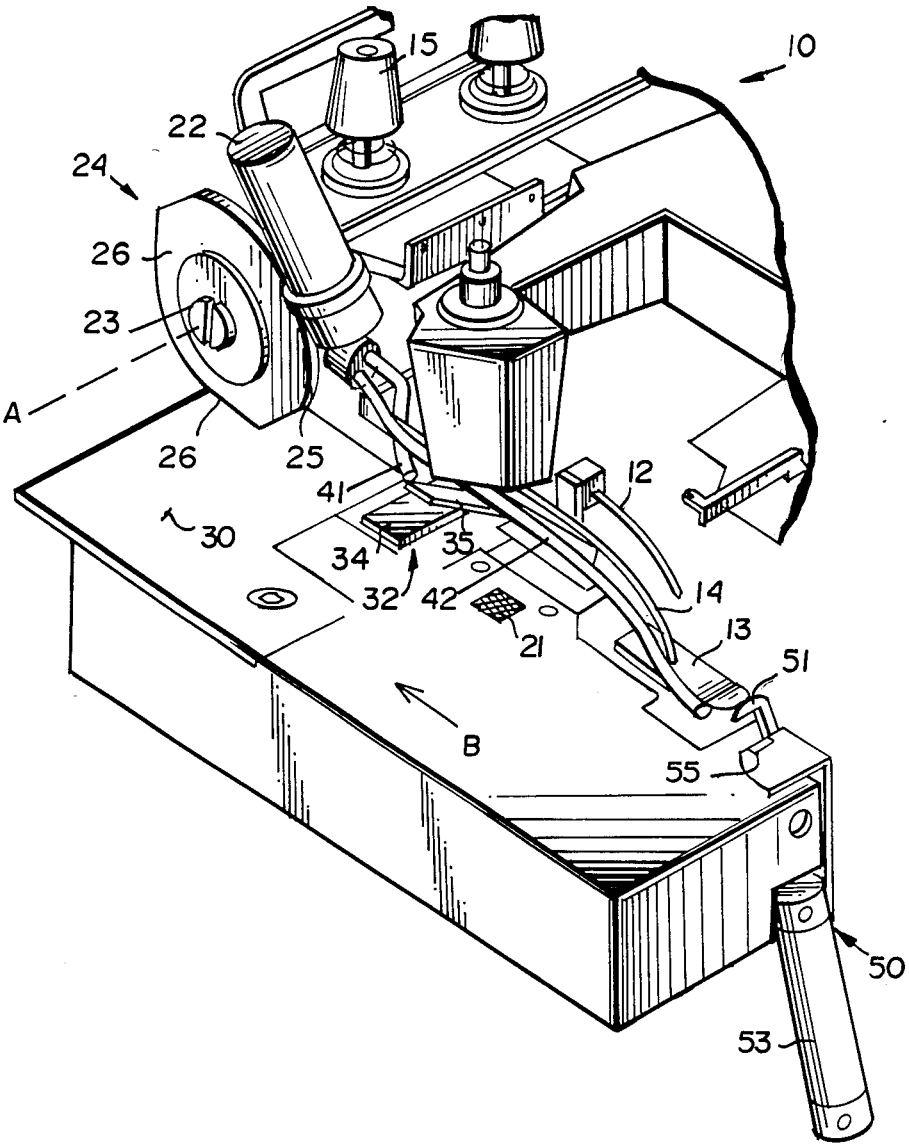
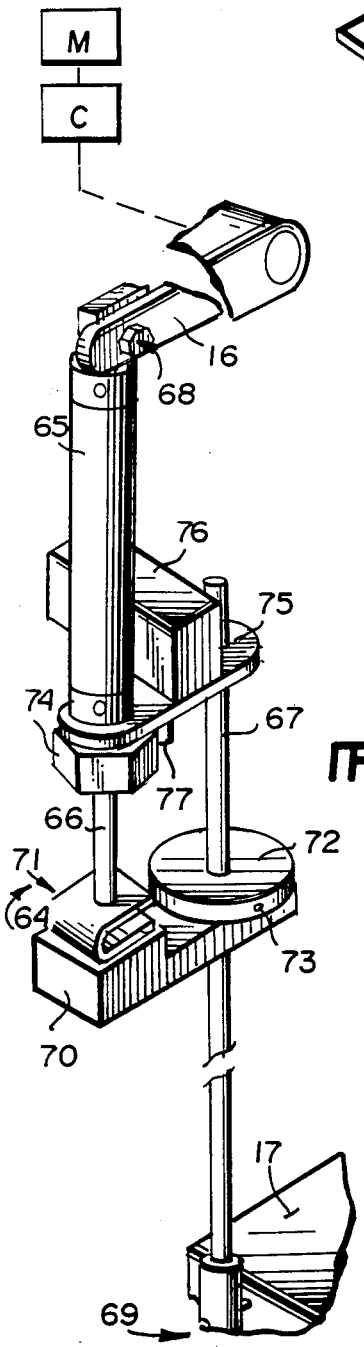
FIG. 3
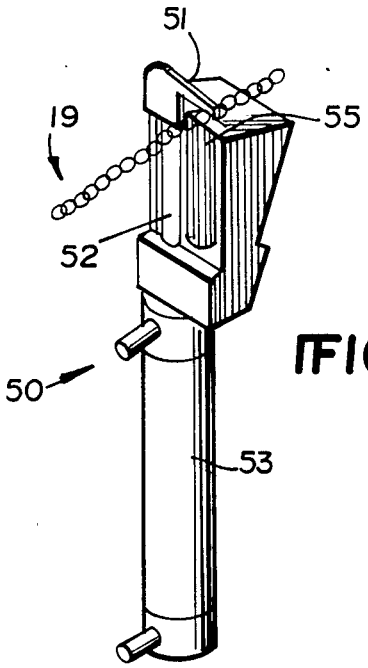
FIG. 5

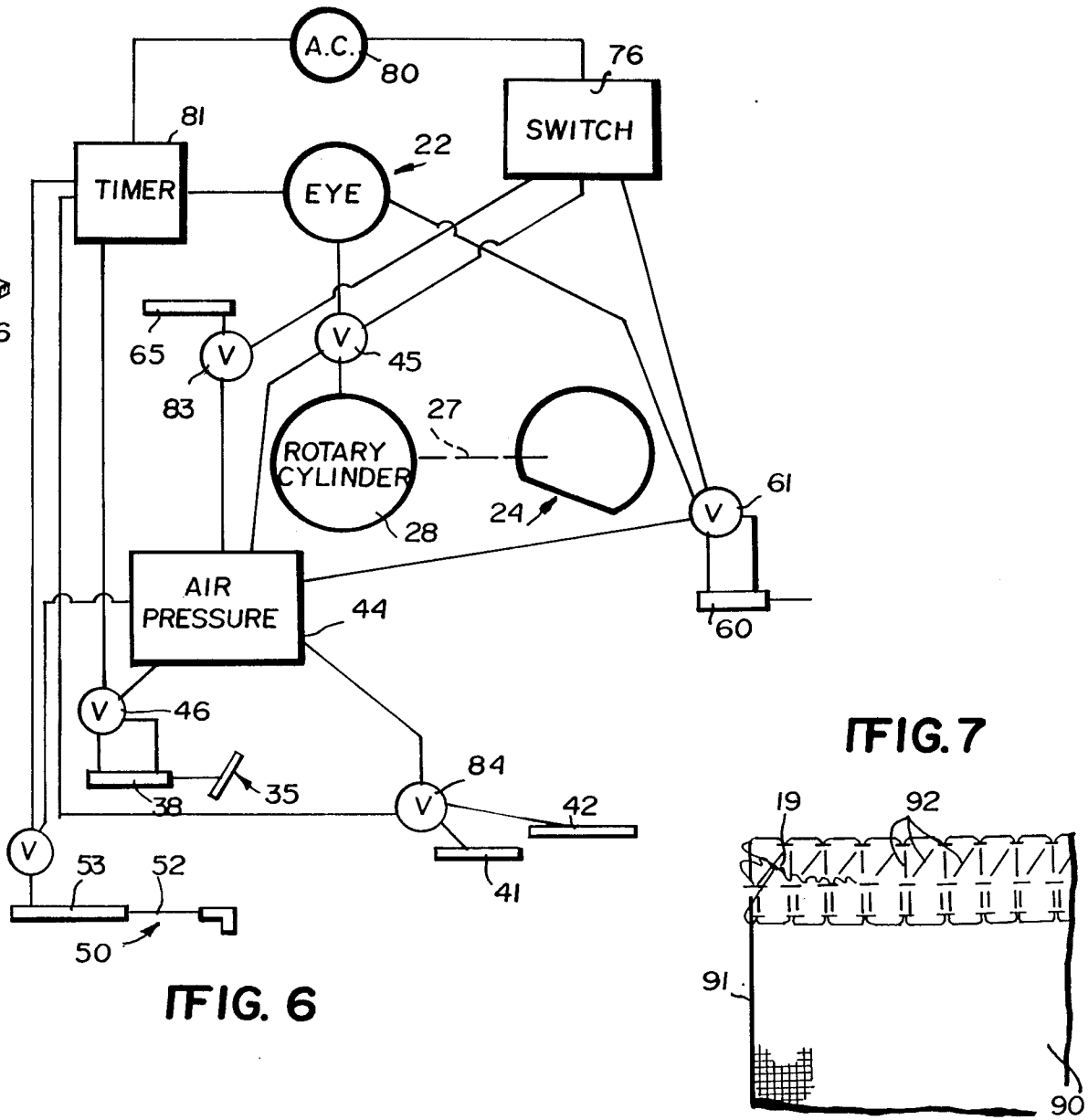
FIG. 7
FIG. 6
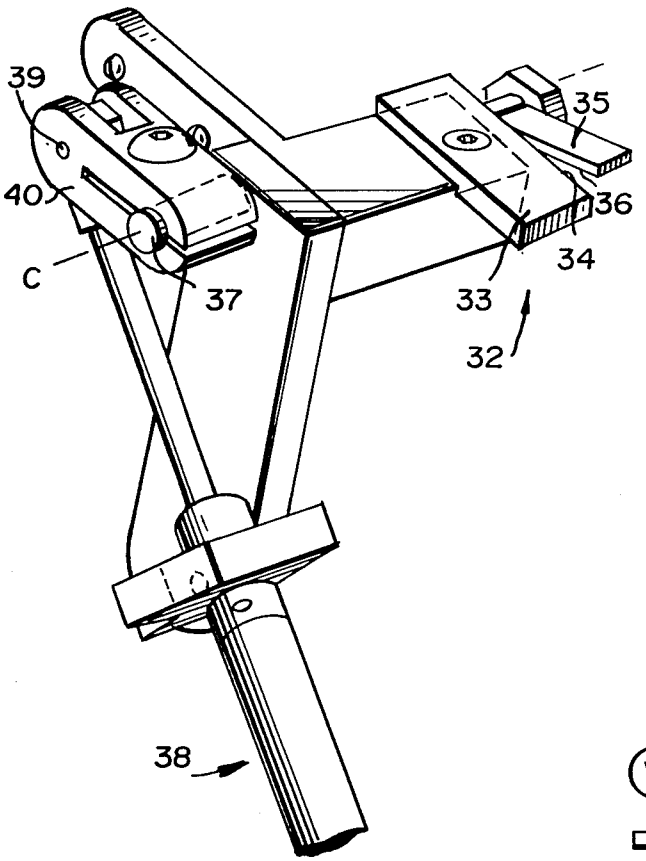
FIG. 4

PROCESS AND APPARATUS FOR STITCHING EXCESS THREAD CHAIN ON A SEWING MACHINE

BACKGROUND AND SUMMARY OF THE INVENTION

When sewing garments, or other articles, with semi-automatic sewing machines, when the sewing of one garment has been completed and an operator lets up on the foot pedal for controlling the sewing machine, it takes a significant period of time before the automatic sewing machine stops stitching the thread chain. During the time that the needle of the sewing machine is still moving, but stitching of the garment has been completed, a thread chain about 1–1½ inches in length may be formed. While conventionally the thread chain can be severed so that not too long a portion thereof extends from the rear of the garment, when sewing is restarted on a second garment the thread chain often extends from the front of the second garment and spoils the appearance of the garment. Therefore, in the conventional commercial practice, the thread chain must be cut off manually, resulting in labor costs that are higher than desirable, and disrupting the ability to automate the garment handling operations.

It has been recognized in the art that it is desirable to fold back the chain stitching so that it will be stitched onto the trailing garment, as exemplified by U.S. Pat. No. 4,038,933. However heretofore there have been a number of practical difficulties associated with producing commercial machines to successfully perform that function, and at the present time there are no known commercial machines in widespread use which do perform the folding-back and stitching function.

According to the present invention an attachment for an automatic sewing machine, and a method of automatically stitching excess thread chain, are provided which result in practical and effective stitching of excess thread chain to a subsequent garment. The attachment and the method according to the present invention are completely automatic so that no operator intervention is necessary; in fact the operator need not even let up on the foot pedal for controlling the semi-automatic sewing machine once the stitching has been completed.

According to one aspect of the present invention, an attachment is provided for a semi-automatic sewing machine having a stitching needle for stitching a thread chain, a presser foot, and a power source. The attachment comprises the following components: A means for sensing the completion of stitching, by the sewing machine, of a first garment, by sensing a trailing portion of the first garment. A means for automatically engaging the first garment in response to the sensing and moving the first garment from the stitching needle more quickly than the sewing machine stitches the thread chain, to pull excess thread chain extending past the trailing portion of the first garment relatively taut. A means for automatically severing the excess thread chain from the trailing portion of the first garment when the excess thread chain is relatively taut; and a means for automatically positioning the excess thread chain with respect to a second garment so that the excess thread chain is stitched to the second garment by the sewing machine.

The automatic sensing preferably is provided by utilizing an electric eye including a target mounted on the base plate of the sewing machine, and the light emitting and sensing mechanism mounted above the target.

The means for automatically engaging the first garment preferably comprises a wheel having the garment engaging portions thereof of rubber, or another elastic material. The wheel is rotated about an axis perpendicular to the direction of the garment movement, and cooperates with the flat surface of the sewing machine to propel the garment away from the needle when an arcuate circumferential portion of the wheel (about 270° of its circumference) is above the surface. Once cut-out (scalloped) portions of the wheel periphery are above the surface, however, the wheel no longer engages the garment even though it continues rotation. At that point the excess thread chain is taut.

The automatic severing means preferably comprises a stationary plate having an edge, the plate disposed between the stitching needle and the wheel. A rotatable plate having an edge cooperating with the edge of the stationary plate is rotated by a shaft to effect severing. A linear actuator is connected to the shaft to effect the rotation.

The means for automatically positioning the excess thread chain comprises a pair of air jets which are blowing means for blowing the threaded chain from its severing position to a position on the opposite side of the stitching needle. A catcher, comprising a catching finger actuated by a linear actuator, and cooperating with a block of rubber, grabs the excess thread chain and holds it in place, while gradually releasing it as it is being stitched into the next garment by the sewing machine.

Means are provided for automatically stopping the stitching action of the sewing machine and raising the presser foot in response to sensing of the trailing portion of the first garment. This means comprises a linear actuator operatively connected between an arm for engaging and disengaging the clutch of the sewing machine, and the foot pedal for operating the sewing machine, and a rod having an enlarged actuator thereon. The linear actuator includes a movable portion thereof which has an abutment for engaging the enlarged portion of the rod, and means for effecting actuation of the linear actuator to move the abutment—in response to the sensing—away from the enlarged attachment to the rod so that the rod does not engage the abutment, thereby causing the arm to move to a clutch disengaging position. A resetting switch is provided on the abutment which is engaged by the rod enlarged portion to reset the components so that the operator, by manipulation of the foot pedal can start the next stitching cycle.

The invention also comprises the individual components of the attachment as described above, which may cooperate with other types of components for performing the same function as the preferred components according to the invention, to produce the desired result.

The invention also relates to a method of automatically stitching excess thread chain to a cloth so that no free stitches are provided on the leading edge of the cloth. The method comprises the steps of: (a) Automatically sensing the completion of stitching, by the sewing machine, of a first cloth, by sensing a trailing portion of the first cloth. (b) Automatically engaging the first cloth in response to the sensing and moving the first cloth away from the stitching needle more quickly than the sewing machine stitches the thread chain, to pull excess thread chain extending past the trailing portion of the first cloth relatively taut. (c) Automatically severing the excess thread chain from the trailing portion of the first garment when the excess thread chain is relatively taut. And (d) automatically positioning the excess thread chain with respect to a second cloth so that the excess thread chain is stitched to the second cloth by the sewing machine, so neither cloth has free stitches extending therefrom.

It is the primary object of the present invention to provide a simple, effective, and practical method and attachment (including components thereof) for automatically stitching excess thread chain to a trailing cloth in the operation of a semiautomatic sewing machine. This and other objects of the invention will become clear from an inspection of the detailed description of the invention, and from the appended claims.

BRIEF DESCRIPTION OF THE DRAWINGS

FIG. 2 is a top, front, perspective, detail view of major operative components of the attachment according to the invention;

FIG. 3 is a perspective view of a linkage drop-off mechanism according to the present invention for automatically terminating (and subsequently resetting) operation of the sewing machine;

FIG. 4 is a detail perspective view of an exemplary severing attachment according to the present invention, including the actuator therefor;

FIG. 5 is a detail perspective view of exemplary catching means according to the present invention, shown in cooperation with a thread chain;

FIG. 6 is an exemplary control schematic illustrating an exemplary interconnection between component parts according to the invention; and FIG. 7 is a top plan view showing the stitching of the excess thread chain to a garment, according to the method of the invention.

DETAILED DESCRIPTION OF THE DRAWINGS

Figure 1:
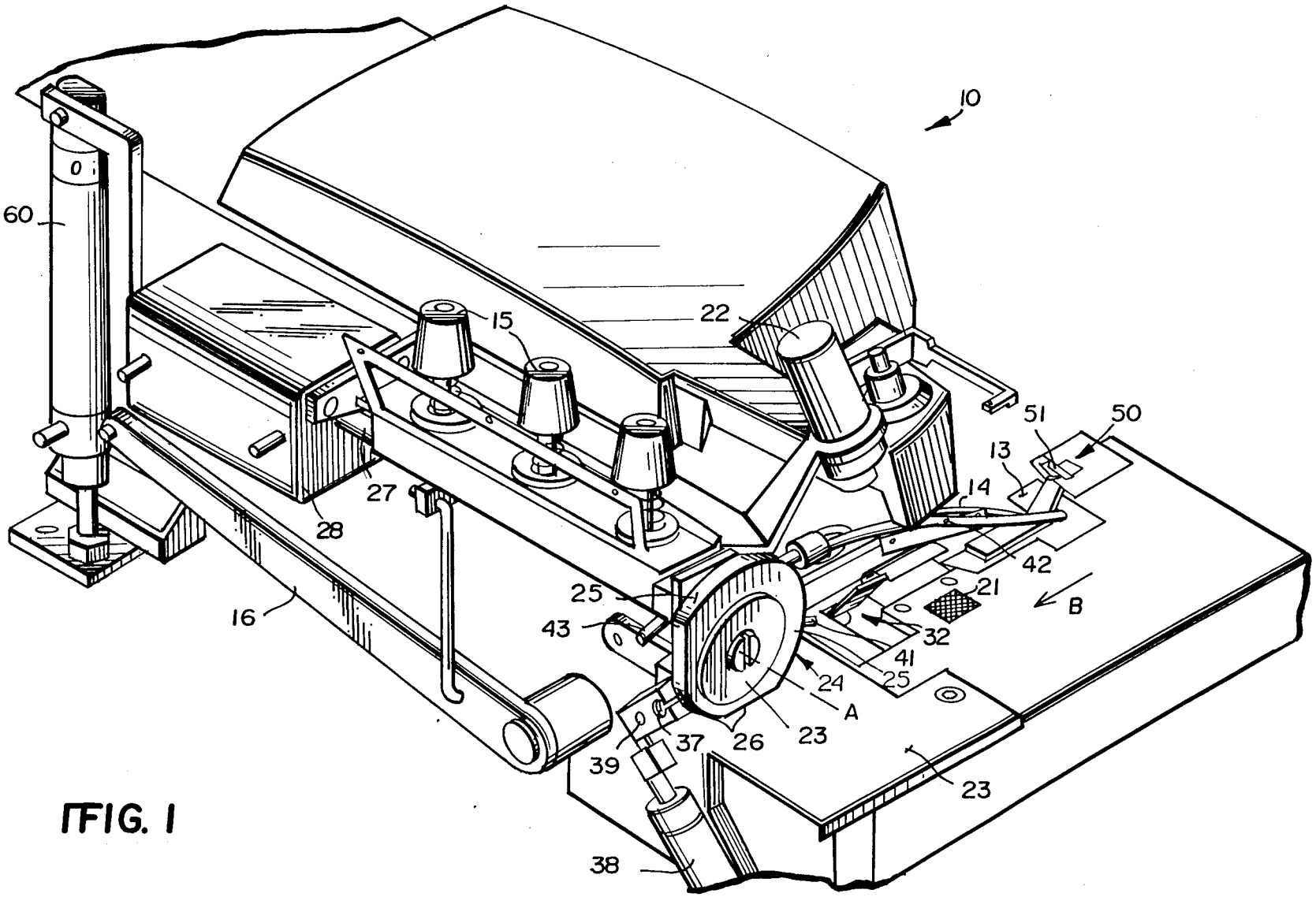
FIG. 1 is a top, rear, perspective view of exemplary apparatus according to the invention shown in conjunction with a conventional semi-automatic sewing machine.

A conventional over-edger type semi-automatic sewing machine is illustrated generally by reference numeral 10 in FIGS. 1 and 2. This machine conventionally has a tongue about ⅜" long, and a throat plate, on the frame of the machine below a presser foot 13 mounted on linkage 14, a stitching needle 12 (see FIG. 2), thread spools 15, and like components. A power source such as an electric motor M, conventionally powers the machine 12. The electric motor is connected through a conventional clutch C to an actuating arm 16 (see FIG. 3), which is controlled by a foot pedal 17.

In conventional commercial practice, after one garment is stitched by a conventional semi-automatic sewing machine, when stitching is completed the operator lets up on the foot pedal, which causes the clutch to be disengaged and the stitching action of the needle to stop. However there is an inherent time delay between the operator's activation of the foot pedal and the actual stopping of the stitching action, with the result that a stitch chain 19 (see FIGS. 5 and 7) is produced. When the stitch chain is, conventionally, severed from the garment that has just been stitched, it normally be will provided as a free chain, or fibers, extending from the leading edge of the next garment to be stitched. This is unsightly, and not acceptable. Therefore the stitch chain either must be cut off manually, or, more desirably, stitched into the seam of the next garment.

According to the present invention, an attachment for the semi-automatic sewing machine 10 for performing the above-desired operation, is provided. A first significant component of the entire attachment comprises means for sensing the completion of stitching by the sewing machine of a first garment by sensing a trailing portion of the first garment. The automatic sensing means preferably comprises electric eye means, such as the eye target 21 (see FIGS. 1 and 2) mounted just downstream of the presser foot 13, and the light emitting and sensing electric eye apparatus 22 mounted above, and in operative association with, the eye target 21.

A second significant component of the entire attachment according to the invention comprises means for automatically engaging a first garment in response to the sensing means 21, 22 and moving the first garment away from the stitching needle 12 more quickly than the sewing machine stitches the thread chain, to pull excess thread chain extending past the trailing portion of the first garment out of engagement with the tongue, and relatively taut. The automatic engaging means according to the invention preferably comprises the wheel 24. The wheel 24 preferably is of rubber or other elastic material, or at least the garment engaging portions thereof are of rubber or the like. In particular, the wheel 24 includes a generally circular arcuate circumferential portion 25, the arcuate extent of the portion 25 preferably being about 270°, as illustrated in FIGS. 1 and 2. A hub 23 mounts the wheel 24 on a shaft 27 which is powered by a rotary pneumatic cylinder 28, or a like power source for rotating the shaft. The axis A defined by the shaft 27, and about which the wheel 24 rotates, is generally perpendicular to the direction of movement B of the garments through the sewing machine 10.

The wheel 24 also has surface means, preferably cutouts or scalloped portions, 26 extending over approximately 90° of the circumference of the wheel. During operation of the wheel 24, which is spaced above the flat surface 30 of the sewing machine 10, when the circumferential portion 25 is above the surface 30, the garment between the portion 25 and surface 30 is engaged by the wheel 24 and propelled in the direction B at the tangential velocity of the portion 25. The portion 25 is dimensioned so that its circumferential extent corresponds generally to the linear extent of a garment portion beneath it so that the stitching chain 19 will be held taut once the portion 25 is at the end of its rotation. The cylinder 28 rotates the shaft 27 approximately 360°, however, and the surface means 26 are provided so that when they are above the surface 30 they do not engage the garment and no longer propel the garment. After completion of an operation cycle, the cylinder 28 rotates the wheel 24 back to its original position (FIGS. 1 and 2).

Another significant component of the complete apparatus according to the invention comprises the automatic severing means illustrated generally by reference numeral 32 in FIGS. 1, 2, and 4, and shown in detail in FIG. 4. The severing means 32 automatically severs the excess thread chain 19 from the trailing portion of a first garment when the excess thread chain is relatively taut. The preferred severing means illustrated in the drawings comprises a stationary plate 33 flush with the surface 30, having an edge 34, and a rotatable plate 35 having an edge 36 which cooperates with the edge 34.

The rotatable plate 35 is affixed to a shaft 37 and is rotatable therewith, the shaft 37 defining an axis D (see FIG. 4) which is parallel to the direction B. A linear actuator, such as piston and cylinder assembly 38, is pivoted at 39 to element 40 which is clamped onto the shaft 37. A single stroke of the piston and cylinder assembly 38 thus rotates the rotatable plate 35 a predetermined amount, to effect severing of the thread chain.

Another significant component of the attachment according to the invention includes means for automatically positioning the excess thread chain 19 with respect to the second garment so that the excess thread chain is stitched into the seam of the second garment by the sewing machine 10. Such positioning means preferably comprise first and second air jets 41, 42 which are connected up through conduit 43 (see FIG. 1) to a source of air under pressure (44 in FIG. 6). This same source of air under pressure 44 may operate through valve 45 to actuate the rotary cylinder 28, and may operate through valve 46 to actuate the linear actuator 38.

The air jets 41, 42 are positioned so that the first air jet 41 will blow the thread chain 19, immediately after severing, to the opposite side of the needle 12 from the position in which it is severed, while the second jet 42 specifically directs the thread chain to the catching means 50.

The catching means 50 is seen most clearly in FIGS. 2 and 5 and preferably includes a catching finger 51 which is mounted on a piston rod 52 associated with the pneumatic cylinder 53. The piston and cylinder assembly 52, 53 comprises a linear actuator for moving the catching finger from a holding position (not shown) to the catching position illustrated in FIGS. 2 and 5. In the catching position illustrated in FIGS. 2 and 5, the air jet 42 blows the thread chain 19 beneath finger 51, and so that it is between the finger 51 and the block of material 55. The finger 51 is in the catching position only instantaneously, and is moved back down into a position where it is retracted. In its retracted position, the catching finger 51 frictionally holds the chain 19 against the block 55 (which preferably is of rubber) so that when the next garment is being stitched, with the excess thread chain 19 being stitched into the seam thereof, the catching means 50 maintains tension on the thread chain 19 and only gradually releases it as the machine is ready to accept it, the thread chain 19 being pulled from between the finger 51 and the block 55.

The cylinder 53 preferably is controlled through valve 57, supplied by the fluid from air pressure source 44.

It is also highly desirable, according to the invention, to provide for automatic stopping of the stitching action of the sewing machine, and for raising of the presser foot 13, in response to the sensing of the traling portion of the first garment by the sensing means 21, 22. This is preferably accomplished by actuation of the cylinder 60 (see FIGS. 1 and 6) as controlled by the electric eye 22, through valve 61 leading to air pressure source 44.

Automatic stopping of the sewing machine is accomplished utilizing the linkage assembly 64 illustrated in FIG. 3. The linkage assembly 64 comprises a linear actuator, such as the pneumatic cylinder 65 and piston 66, which are operatively connected between the arm 16 and the foot pedal 17, and a rod 67 likewise operatively connected between the arm 16 and the foot pedal 17. For instance, one end of the cylinder 65 may be pivotally attached at 68 to the arm 16, while one end of the rod 67 is pivotally connected at 69 to the foot pedal 17.

Connected to the movable portion (piston rod) 66 of the linear actuator is an abutment 70, a cushioning means, such as provided by a bent over strip of rubber 71, preferably being provided between cylinder 65 and the abutment 70. The rod 67 has an enlarged portion, in the form of disc 72 which is held thereon by a set screw 73, which is adapted to cooperate with the abutment 70. Also mounted to the cylinder 65, as by the nut 74, is the platform 75, through which the rod 67 extends. Mounted on the platform 75 is the resetting means, such as switch 76 which is actuated by an actuator 77 adapted to engage the disc 72.

FIG. 6 illustrates in schematic form various interconnections between the components. An A.C. source 80 supplies power to the electric eye 22, the switch 76, and the timer 81. The supply of air to the pneumatic cylinder 65 is through the valve 83. The supply of air to the air jets 41, 42 is through the valve 84. All of the valves 45, 46, 57, 61, 83, and 84 preferably are solenoid actuated.

Operation

A typical operation of the apparatus, in the practice of the method according to the invention, will now be described.

As a first garment moves in direction B in FIG. 1 a seam is stitched by the needle 12 of the semi-automatic sewing machine 10, until the garment gets to the point where stitching is completed at which time the trailing edge thereof uncovers eye target 21, which causes the electric eye 22 to be actuated. Actuation of the eye 22 causes immediate actuation of the valve 83 to supply fluid to the cylinder 65 so that the piston 66 moves downwardly in FIG. 3, causing the abutment 70 to no longer engage the disc 72. When this happens, despite the fact that the operator may still be pressing down on the foot pedal 17, the linkage assembly 64 is "too long", and it no longer can retain the arm 16 in a downward position. Therefore the arm 16 moves upwardly to its normal, spring-biased position, deactivating the conventional automatic clutch for the sewing machine 10 and causing the stitching action of the sewing machine 10 to stop. In this way a minimum amount of excess thread chain 19 (e.g. about 1½ inches) is produced.

The electric eye 22 also automatic actuates the valve 45, which supplies air to the rotary cylinder 28. This causes the shaft 27 to rotate approximately 360°. During this rotation, the leading part of the circumferential portion 25 will come directly over the surface 30, which will cause the first garment to be engaged and propelled in the direction B at a speed greater than the speed at which the needle 12 is produced stitch chain (the needle 12 still producing stitch chain because it is not possible to instanteously terminate that action), and will continue to be propelled in the direction B until the stitch chain is taut. As the stitch chain becomes taut, the circumferential portion 25 no longer is above the flat surface 30, but rather the surface means 26 are, and therefore the garment is no longer propelled. During propelling action of the garment in direction B by the wheel 24, the stitch chain is also pulled off of the thread tongue which is below the presser foot 13.

The electric eye 22 also controls the valve 61 to supply fluid to the cylinder 60 which causes the linkage 14 to effect movement of the presser foot 13 away from the surface 30, allowing the action of the wheel 24 pulling on the garment to tighten the stitch chain 19.

The electric eye 22 also controls the valves 46, 57, and 84 through a timer 81. The timer 81 preferably introduces a time delay of approximately 0.2 seconds, which is enough time for the garment pulling and chain stitch tightening action to occur. After this time delay of approximately 0.2 seconds, the valve 46 is actuated so that air is supplied to cylinder 38, causing rotation of shaft 37 and severing of the thread chain 19 by the edges 34, 36 severing the thread chain. Simultaneously with that, the air jets 41, 42 are temporarily actuated so that the jet 41 blows the thread chain 19 in a direction opposite to the direction B, toward the jet 42, and the jet 42 blows the thread chain between the catching finger 51 and the block 55. Note that actuation of valve 57 by the timer 81 has caused the cylinder 53 to move the piston rod 52 so that the finger 51 is in a position to accept the chain 19. The valves 46, 57, 84 are actuated by the timer 81 for only a short period of time (e.g. for about 0.2 seconds after about a 0.2 second delay), just enough time for the thread chain 19 to be severed and to be caught between the finger 51 and the rubber block 55. Then the termination of air delivery to the jets 41, 42, movement of the rotatable plate 35 back to its original position, and retraction of the piston 52, are effected.

After the above described procedures, the operator resets the assembly merely by "heeling" the foot pedal which causes the disc 72 to move upwardly and engage the switch actuator 77 of the resetting switch 76. This resetting action causes the valves 45, 61 and 83 to be controlled so that the linkage 64 again "shortens up" so that the foot pedal 17 controls the operation of the automatic clutch through arm 16 (the piston rod 66 returning to its position of FIG. 3), the presser foot 13 is moved downwardly to its position of FIGS. 1 and 2 by actuation of the cylinder 60, and the rotary cylinder 28 is reversed to move the wheel 24 back to its original position.

When the operator then moves the second garment into operative association with the stitching needle 12, the operator will push down on the foot pedal 17, again causing the automatic clutch to the engaged and for the sewing machine 10 to form a seam in the second garment. Since the stitch chain 19 is held directly over the second garment, it is stitched into the seam of the second garment, the excess thread chain 19 being slowly pulled from between the finger 51 and the block 55 as the stiching action occurs. The leading edge of the second garment will then ultimately appear generally as illustrated in FIG. 7, wherein the second garment 90 having a leading edge 91 thereof has stitching 92 formed by the sewing machine 10, with the excess thread chain 19 stitched into the seam formed by the stitching 92.

It will thus be seen that according to the present invention a practical and effective method and apparatus have been provided for folding-back and stitching into a trailing garment excess thread chain from the stitching of a previous garment. While the inventon has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent attachments, structures, and procedures.

What is claimed is:

1. An attachment for a semi-automatic sewing machine, having a stitching needle for stitching a thread chain, a presser foot, and a power source, comprising:

means for automatically sensing the completion of stitching, by the semi-automatic sewing machine, of a first garment, by sensing a trailing portion of the first garment;

means for automatically engaging the first garment in response to said sensing and moving the first garment away from the stitching needle more quickly than the sewing machine stitches the thread chain, to pull excess thread chain extending past the trailing portion of the first garment relatively taut;

means for automatically severing the excess thread chain from the trailing portion of the first garment when the excess thread chain is relatively taut; and means for automatically positioning the excess thread chain with respect to a second garment so that the excess thread chain is stitched to the second garment by the sewing machine.

2. An attachment as recited in claim 1 wherein said automatic positioning means comprises: blowing means for blowing said stitch chain from the position at which it is severed to a position on the opposite side of the stitching needle; and catching means for catching the thread chain at said position on the opposite side of the stitching needle and gradually releasing the excess thread chain as it is stitched to the second garment.

3. An attachment as recited in claim 2 wherein said catching means maintains tension on said excess thread chain by frictionally engaging said excess thread chain, to gradually release it as it is stitched to the second garment.

4. An attachment as defined in claim 2, wherein said blowing means comprises first and second air jets, said first jet adapted to blow said stitch chain from the position at which it is severed to a position on the opposite side of the stitching needle, and said second jet adapted to direct said stitch chain directly to said catching means.

5. An attachment as recited in claim 3 wherein said catching means comprises a catching finger; a linear actuator operatively connected to said catching finger for moving said catching finger from a catching to a holding position; and a block of material stationary with respect to said catching finger and cooperating with said catching finger so that said catching finger holds the excess thread chain between it and said block of material.

6. An attachment as recited in claim 1 wherein said means for automatically engaging the garment in response to said sensing comprises a wheel rotatable about an axis perpendicular to the direction of movement of the garment; a flat surface cooperating with said wheel; means for rotating said wheel about its axis; a generally circular arcuate circumferential portion of said wheel cooperating with said stationary surface so that when said circular arcuate circumferential portion of said wheel is above said stationary surface with said garment therebetween the wheel propels the garment in the direction of rotation of the wheel; and surface means of said wheel defining non-garment propelling portions of said wheel so that when said surface portions of said wheel are directly above said stationary surface said garment is not propelled even though said wheel may rotate.

7. An attachment as recited in claim 6 wherein said wheel garment-engaging portions are made of an elastic material, and wherein said arcuate portion thereof has an arcuate circumferential extent of approximately 270°.

8. An attachment as recited in claim 1 wherein said severing means comprises a stationary plate having an edge, said plate disposed between said stitching needle and said automatic engaging means; a rotatable plate having an edge cooperating with the edge of said stationary plate; a shaft operatively connected to said rotatable plate and defining an axis about which the rotatable plate rotates; and a linear actuator operatively connected to said shaft for effecting rotation of said shaft to thereby move said movable plate from a non-severing position to a severing position.

9. An attachment as recited in claim 1 further comprising means for automatically stopping stitching action of said sewing machine, and raising said presser foot, in response to said sensing of the trailing portion of a first garment; and wherein said sensing means comprises electric eye means.

10. An attachment as recited in claim 9 wherein said semi-automatic sewing machine comprises a foot pedal actuator for actuating an arm for engaging a clutch, when the arm is actuated to engage the clutch the sewing machine operating to effect stitching, and when the arm disengages the clutch the sewing machine terminating stitching; and wherein said means for automatically stopping stitching action of said sewing machine comprises a linear actuator operatively connected between said arm and said foot pedal, and a rod having an enlarged actuator thereon operatively connected between said arm and said foot pedal; said linear actuator including a movable portion thereof which has an abutment for engaging said enlarged portion attached to said rod; and means for effecting actuation of said linear actuator to move said abutment, in response to said sensing, away from said enlarged attachment to said rod so that said rod does not engage said abutment, thereby causing the arm to move to a clutch disengaging position.

11. A method of automatically stitching excess thread chain to a cloth so that no free stitches are provided on the leading edge of the cloth, utilizing a semi-automatic sewing machine having a stitching needle for stitching the thread chain, the method comprising the steps of:

(a) automatically sensing the completion of stitching, by the semi-automatic sewing machine, of a first cloth, by sensing a trailing portion of the first cloth;

(b) automatically engaging the first cloth in response to the sensing and moving the first cloth away from the stitching needle more quickly than the sewing machine stitches the thread chain, to pull excess thread chain extending past the trailing portion of the first cloth relatively taut;

(c) automatically severing the excess thread chain from the trailing portion of the first cloth when the excess thread chain is relatively taut; and (d) automatically positioning the excess thread chain with respect to a second cloth so that the excess thread chain is stitched to the second cloth by the sewing machine, so neither cloth has free stitches extended therefrom.

12. A method as recited in claim 11 wherein step (d) is practiced by blowing the stitch chain from the position at which it is severed to a position on the opposite side of the stitching needle, catching the thread chain at the position on the opposite side of the stitching needle, and gradually releasing the excess thread chain as it is stitched to the second cloth.

13. A method as recited in claim 11 wherein the sewing machine has a presser foot and a foot pedal actuator for actuating an arm for engaging a clutch, when the arm is actuated to engage the clutch the sewing machine operating to effect stitching, and when the arm disengages the clutch the sewing machine terminating stitching; and comprising the further steps of automatically acting on the arm for disengaging the clutch and raising the presser foot in response to step (a), and after step (d) allowing manual reactuation of the foot pedal to move the arm for engaging the clutch.

14. A linkage assembly for a semi-automatic sewing machine which comprises a foot pedal actuator for actuating an arm for engaging a clutch, when the arm is actuated to engage the clutch the sewing machine operating to effect stitching, and when the arm disengages the clutch the sewing machine terminating stitching:

means for automatically stopping stitching action of said sewing machine comprising a linear actuator operatively connected to said arm and said foot pedal, and a rod having an enlarged actuator thereon operatively connected to said arm and said foot pedal;

said linear actuator including a movable portion thereof which has an abutment for engaging said enlarged portion attached to said rod; and means for effecting actuation of said linear actuator to move said abutment away from said enlarged attachment to said rod so that said rod does not engage said abutment, thereby causing the arm to move to a clutch disengaging position.

15. An assembly as recited in claim 16 further comprising resetting means operatively associated with said linear actuator, for actuation by said enlarged portion for resetting said linear actuator after the arm has moved to a clutch disengaging position; and further comprising cushioning means operatively connected between said linear actuator and said abutment.

16. An assembly as recited in claim 14, wherein said means for effecting actuation of said linear actuator comprises sensing means for detecting a trailing portion of a first garment.

17. An assembly as recited in claim 16, wherein said sensing means comprises electric eye means.

18. An attachment for a semi-automatic sewing machine, having a stitching needle for stitching a thread chain, a presser foot, and a power source, comprising:

means for positioning any excess thread chain extending from a trailing edge of an article which has just been stitched by the sewing machine after severing of the excess thread chain from the article, said positioning means comprising:

blowing means for blowing said stitch chain from the position at which it is severed to a position on an upstream, first side of the stitching needle;

catching means for catching the thread chain at said position on the upstream side of the stitching needle and maintaining tension on said excess thread chain by frictionally engaging it, to gradually release it as it is being stitched to another garment; and said catching means comprising a catching finger; a linear actuator operatively connected to said catching finger for moving said catching finger from a catching to a holding position; and a block of material stationary with respect to said catching finger and cooperating with said catching finger so that said catching finger frictionally holds the excess thread chain between it and said block of material.

19. An attachment as recited in claim 18 wherein said block material is a block of rubber.

* * * * *